US011134737B2

(12) United States Patent
Ross

(10) Patent No.: US 11,134,737 B2
(45) Date of Patent: Oct. 5, 2021

(54) RECONFIGURABLE LIGHTING SYSTEM FOR HELMET

(71) Applicant: First-Light USA, LLC, Seymour, IL (US)

(72) Inventor: Jeremy B. Ross, Monticello, IL (US)

(73) Assignee: First-Light USA, LLC, Seymour, IL (US)

( * ) Notice: Subject to any disclaimer, the term of this patent is extended or adjusted under 35 U.S.C. 154(b) by 0 days.

(21) Appl. No.: 16/538,033

(22) Filed: Aug. 12, 2019

(65) Prior Publication Data

US 2020/0068976 A1 Mar. 5, 2020

Related U.S. Application Data

(60) Provisional application No. 62/723,672, filed on Aug. 28, 2018.

(51) Int. Cl.

| | |
|---|---|
| ***A42B 3/04*** | (2006.01) |
| ***F21K 9/20*** | (2016.01) |
| ***F21L 4/02*** | (2006.01) |
| ***F21V 21/084*** | (2006.01) |
| ***F21V 31/00*** | (2006.01) |
| ***F21V 19/00*** | (2006.01) |
| *F21Y 115/10* | (2016.01) |

(52) U.S. Cl.

CPC ..... *A42B 3/044* (2013.01); *F21K 9/20* (2016.08); *F21L 4/02* (2013.01); *F21V 19/0015* (2013.01); *F21V 21/084* (2013.01); *F21V 31/00* (2013.01); *F21Y 2115/10* (2016.08)

(58) Field of Classification Search

CPC ..... F21L 4/02; F21K 9/20; F21V 19/0015; F21V 21/084; F21V 31/00; A42B 3/044; A61B 5/251; A61B 5/256; A61B 5/257

See application file for complete search history.

(56) References Cited

U.S. PATENT DOCUMENTS

| | | | | |
|---|---|---|---|---|
| 5,340,662 | A * | 8/1994 | McCarter | H01M 6/32 429/101 |
| 6,941,952 | B1 * | 9/2005 | Rush, III | A63B 71/085 128/845 |
| 8,025,432 | B2 | 9/2011 | Wainright | |
| 2004/0008106 | A1 * | 1/2004 | Konczal | A42B 3/0453 340/432 |
| 2005/0265015 | A1 | 12/2005 | Salazar | |
| 2007/0000031 | A1 * | 1/2007 | Makris | A62B 18/082 2/411 |

(Continued)

FOREIGN PATENT DOCUMENTS

WO 02/077523 A1 10/2002

OTHER PUBLICATIONS

International Search Report and Written Opinion dated Oct. 23, 2019, from the ISA/European Patent Office, for International Patent Application No. PCT/US2019/046134 (filed Aug. 12, 2019), 10 pages.

(Continued)

*Primary Examiner* — Rajarshi Chakraborty
*Assistant Examiner* — Nathaniel J Lee
(74) *Attorney, Agent, or Firm* — Ascenda Law Group, PC

(57) ABSTRACT

A lighting system for a helmet, and in particular an aircrew member's helmet, which lighting system includes reconfigurable strips of light emitting diode (LED) lights.

21 Claims, 8 Drawing Sheets

(56) References Cited

U.S. PATENT DOCUMENTS

| | | | | |
|---|---|---|---|---|
| 2007/0025100 | A1 | 2/2007 | Caruana | |
| 2009/0229040 | A1 | 9/2009 | McLean et al. | |
| 2009/0303698 | A1* | 12/2009 | Huss | A42B 3/044 362/105 |
| 2015/0036328 | A1* | 2/2015 | Swan | A42B 3/044 362/157 |
| 2015/0250245 | A1* | 9/2015 | Waters | A42B 1/0182 362/106 |
| 2016/0150844 | A1* | 6/2016 | Das | G02B 27/017 359/519 |
| 2018/0190095 | A1 | 7/2018 | Leegate et al. | |

OTHER PUBLICATIONS

International Preliminary Report on Patentability dated Mar. 11, 2021, from the International Bureau of WIPO, for International Patent Application No. PCT/US2019/046134 (filed Aug. 12, 2019), 7 pgs.

* cited by examiner

RECONFIGURABLE LIGHTING SYSTEM FOR HELMET

RELATED APPLICATIONS

This is a Nonprovisional of, claims priority to, and incorporates by reference U.S. Provisional Application 62/723,672, filed Aug. 28, 2018.

FIELD OF THE INVENTION

The present invention provides a lighting system for a helmet, and in particular an aircrew member's helmet, which lighting system includes reconfigurable strips of light emitting diode (LED) lights.

BACKGROUND

Safety helmets such as those worn by motorcyclists and bicyclists are known to include integrated LED lights to provide visual identification for the wearer when on the road. Examples of such helmets are described in U.S. PGPUBs 2009/0229040 of McLean and Brown, 2005/0265015 of Salazar, and 2007/0025100 of Caruana. Further, helmets worn as safety devices by construction workers, miners, etc. may also have LED lighting systems, as described in U.S. Pat. No. 8,025,432 to Wainright. In all of these instances, however, the lighting systems are integral to the helmet and a wearer is not able to remove the lights from the helmet or reorient the lights in different positions thereon.

SUMMARY OF THE INVENTION

A lighting system for a helmet, and in particular an aircrew member's helmet, which lighting system includes reconfigurable strips of light emitting diode (LED) lights.

A helmet configured in accordance with one embodiment of the invention includes one or more strips of light emitting diode (LED) lights, said strips of LED lights being removably secured to the helmet, an on/off switch to allow a wearer to set an on/off status of the LED lights, and an indicator to allow the wearer to observe the status of the LED lights. The on/off switch may be a manual on/off switch operable by the wearer. The helmet also may include a power supply for the LED lights, for example, a water activated battery that is a component of the on/off switch. Alternatively, or in addition, the power supply may include a hand-powered generator.

In one embodiment, the strips of LED lights are removably secured to the helmet by hook and eye fasteners. For example, a first strip of male or female hook and eye elements disposed/adhered in a recessed channel of the helmet may engage a corresponding second strip of female or male hook and eye elements adhered to one of the one or more strips of LED lights. The recessed channel may be deep enough so that a top portion of the LEDs of the one of the one or more strips of LED lights is flush with or slightly protrudes above a top surface of the helmet.

The on/off switch may, in some instances, be a push on/push off unit. Also, the on/off switch may be included in a panel with the indicator at a periphery of a front frame of the helmet. Generally, the on/off switch and the indicator may be included in a single push on/push off unit.

The strips of LED lights may include multiple kinds of LEDs, each individually operable from a panel that includes the indicator. For example, at least some of the strips of LED lights may be configured with some LEDs that provide light in visible wavelengths, some of the strips of LED lights may be configured with some LEDs that provide light in infra-red wavelengths, and some of the strips of LED lights may be configured with some LEDs that provide light in ultra violet wavelengths. Generally, different ones of the strips of LED lights may be configured with some LEDs that provide light in different ones of visible, infra-red, or ultra violet spectrums. Alternatively, or in addition, different ones of the LED lights may be selectively controllable to provide different wavelengths of illumination, or, more generally, different ones of the LED lights may be selectively controllable to provide illumination, either in a visible light spectrum at a same or different colors, and/or in other light spectrums.

In some embodiments, one or more of the strips of LED lights may also include one or more sensor pads configured to provide monitoring of a wearer's vital statistics, electrophysiological state, or other bioinformation. In other instances, the helmet may include one or more sensor pads to provide monitoring of a wearer's vital statistics, electrophysiological state, or other bioinformation, for example integrated in a headband associated with the helmet. Or, a vital statistics sensor pad may be mounted to the indicator, e.g., attached to the indicator by a quick release connector.

The helmet may have separate types of LED lights, which have separate, respective status indicators and separate, respective on/off switches. One or more of the LED lights, and/or one or more of the strips of LED lights may be coupled to a programmed controller that is configured to provide an illumination pattern according to a position of a selector.

BRIEF DESCRIPTION OF THE DRAWINGS

The present invention is illustrated by way of example, and not limitation, in the figures of the accompanying drawings, in which.

DETAILED DESCRIPTION

Described herein is a lighting system for a helmet, and in particular an aircrew member's helmet, which lighting system includes reconfigurable strips of light emitting diode (LED) lights. By making the LED lights removable, preferably in strips, they can be reoriented on the helmet or another part of the wearer's clothing or body, to assist in communicating with others. For example, the lights can be rearranged to be better oriented in a direction for being seen by others, to permit the wearer to see other items, to indicate the wearer's physical status, to indicate the presence of others, or to communicate other information. Further, the lighting system is provided with a manual on/off switch and indicator to allow a wearer to observe and manually set the status of the light elements. Also, power means such as a water activated battery, one-time use or rechargeable cell(s), hand-powered generator, or other means are provided. In some embodiments, the water activated battery may also act as a switch so that when it is activated (e.g., by immersion in water), it immediately powers one or more of the LED strips, thereby lighting the associated LEDs on the strip(s).

Figure 1B:
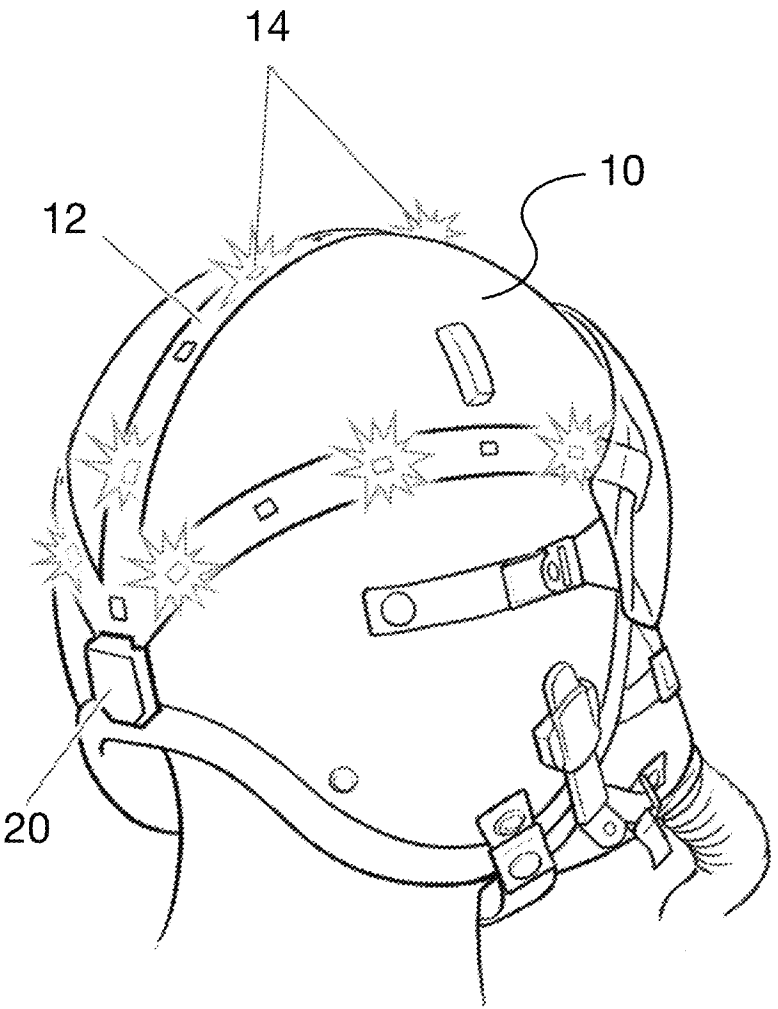
FIGS. 1A-1C illustrate a helmet fitted with one or more reconfigurable strips of LED elements, in accordance with embodiments of the present invention.
Figure 1A:
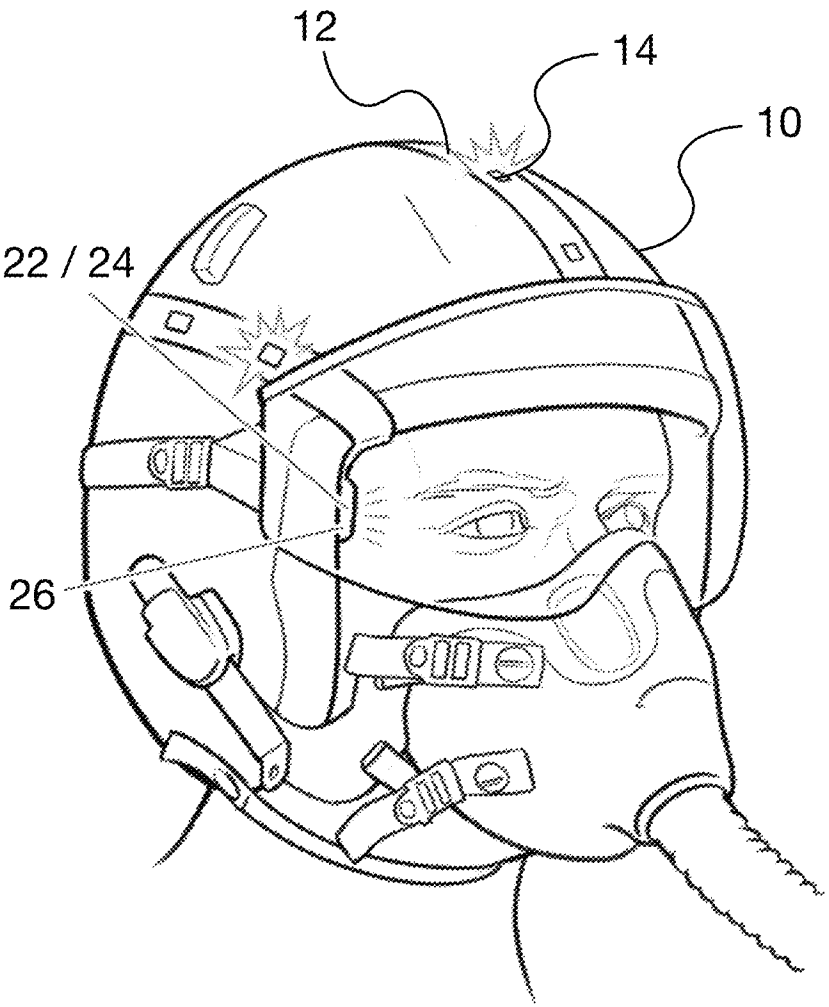
Figure 2D:
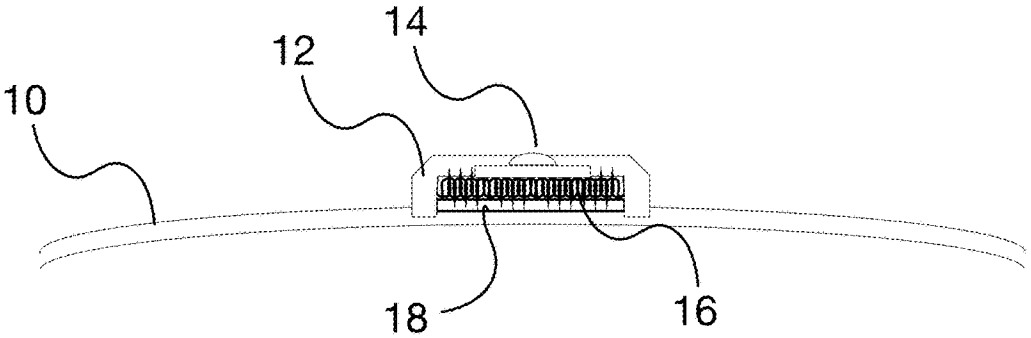
FIGS. 2A-2E illustrate examples of LED elements arranged in strips for use in connection with a helmet, as illustrated in FIGS. 1A-1C, in accordance with embodiments of the present invention.
Figure 2E:
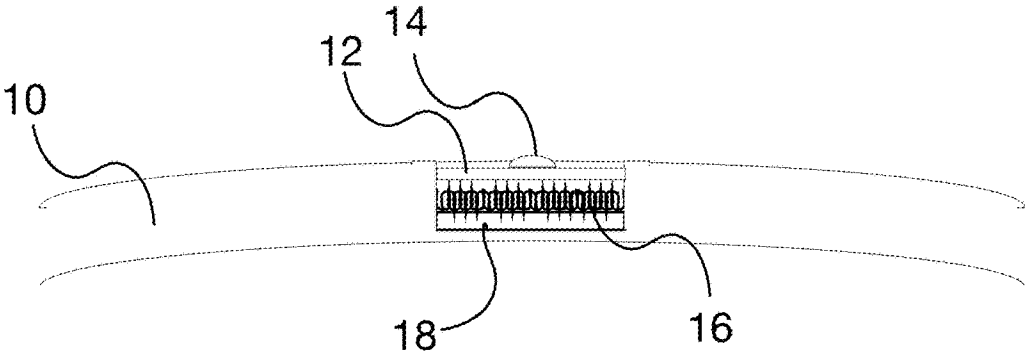
Figure 1C:
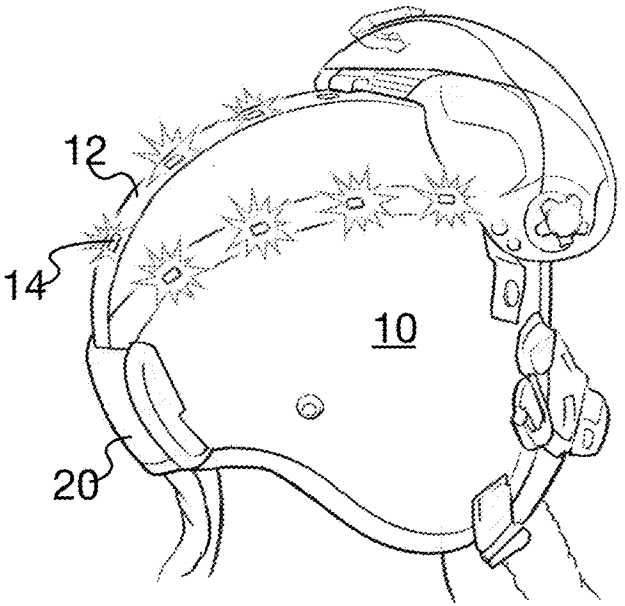
Figure 2A:
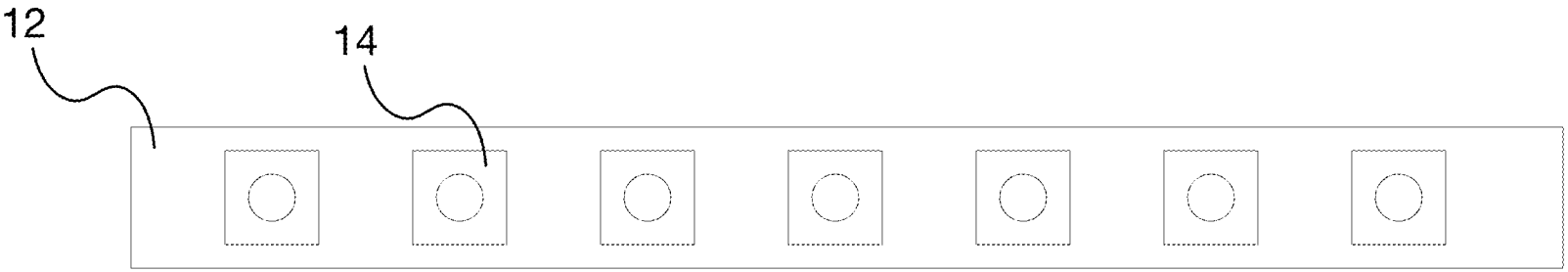
Figure 2B:
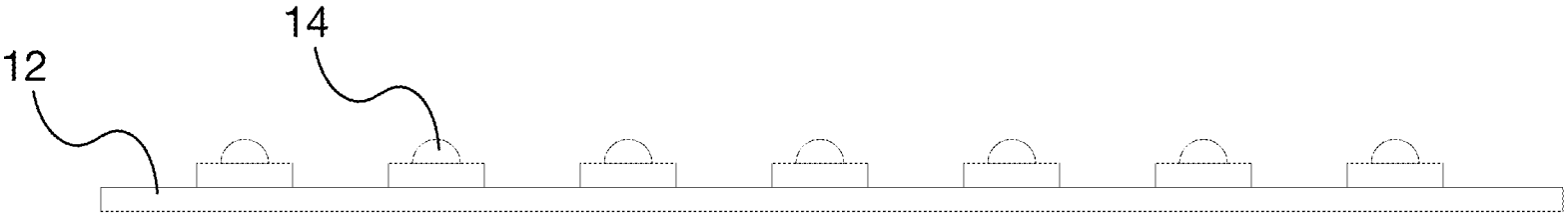
Figure 2C:
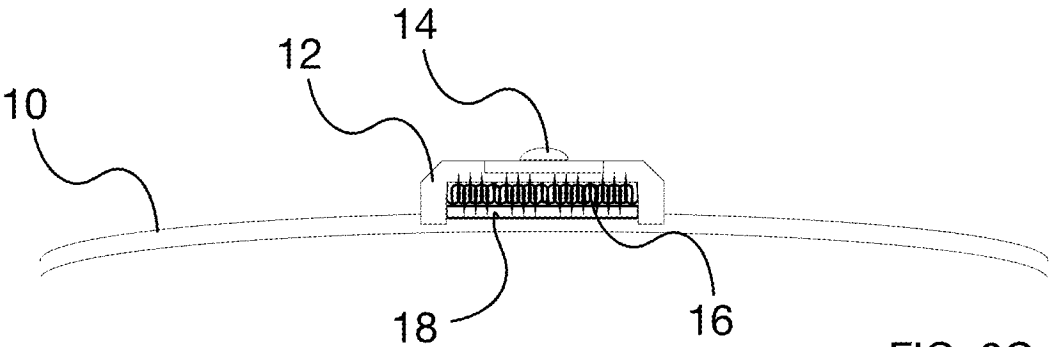

Referring now to FIGS. 1A-1C and 2A-2E, a helmet 10 is fitted with one or more strips 12 of LED elements 14. The individual strips 12 of LED elements 14 are secured to helmet 10 using hook and eye fasteners 16. For example, a strip of male or female hook and eye elements may be adhered within one or more recessed channels 18 in helmet 10. A corresponding strip of female or male hook and eye elements may be adhered to the back of an LED strip 12. Then the two corresponding strips of hook and eye elements may be brought together, securing the LED strip 12 to the helmet 10. By placing strips of male or female hook and eye elements at various locations on helmet 10, the arrangement of the LED strips 12 may be varied by the wearer as circumstances dictate. As shown in FIGS. 2D and 2E, in some embodiments the recessed channels 18 may be deep enough so that a top portion of the LEDs 14 is flush with or slightly protrudes above a top surface of helmet 10 when the LED strips 12 are secured using hook and eye fasteners 16. This arrangement may be beneficial in reducing drag and possible dislocation/dislodgement of the LED strips due to high velocity air rushing by the helmet in cases of ejection, parachuting, etc. Orienting the channels and the LED strips in advantageous aerodynamic directions (e.g., fore and aft) may further assist in keeping the LED strips secured to the helmet in such circumstances.

Figure 3:
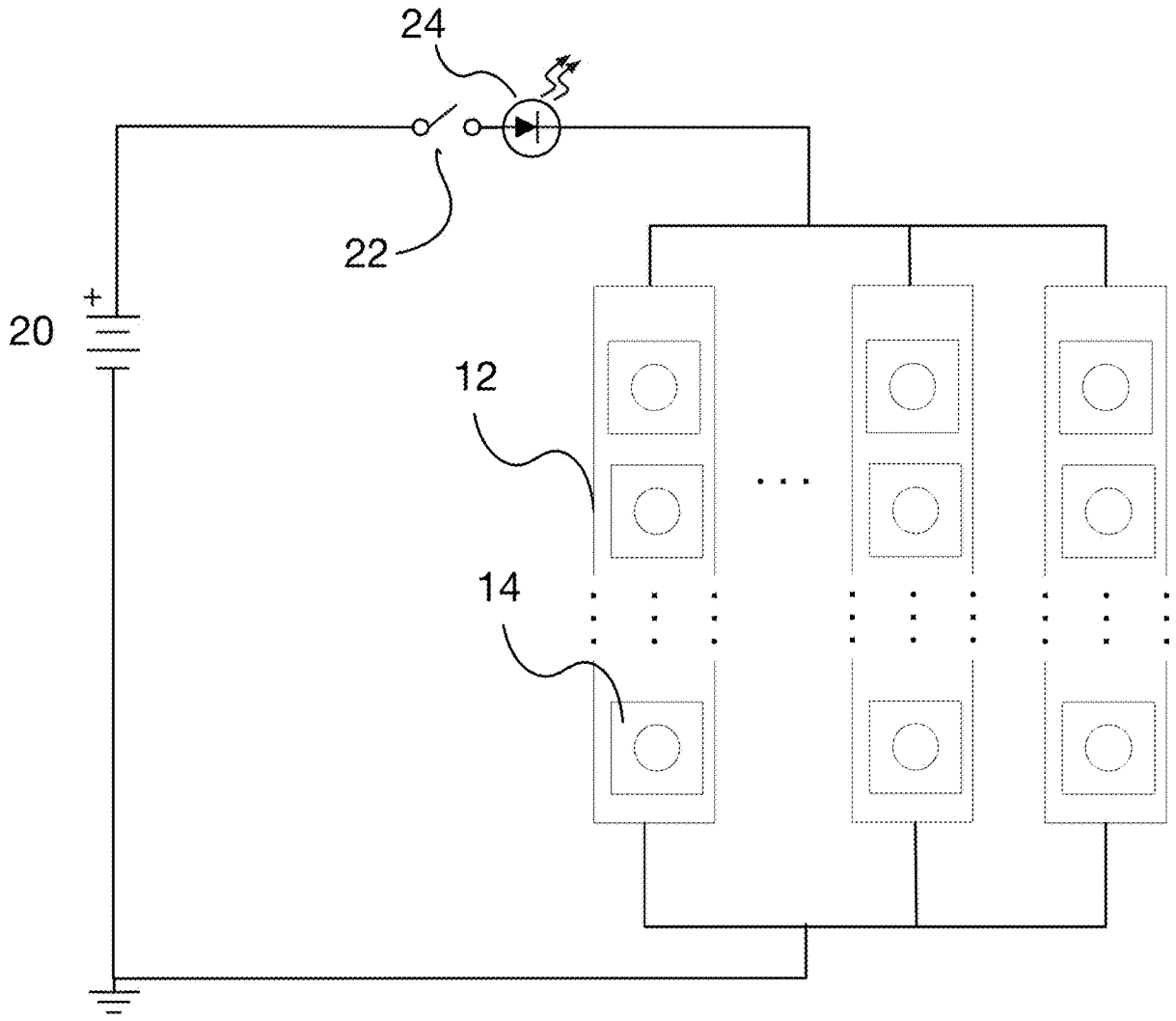
FIG. 3 provides a simplified view of electrical connections for LED elements arranged in strips for use in connection with a helmet, as illustrated in FIGS. 1A-1C and a power source, in accordance with embodiments of the present invention.
Figure 4B:
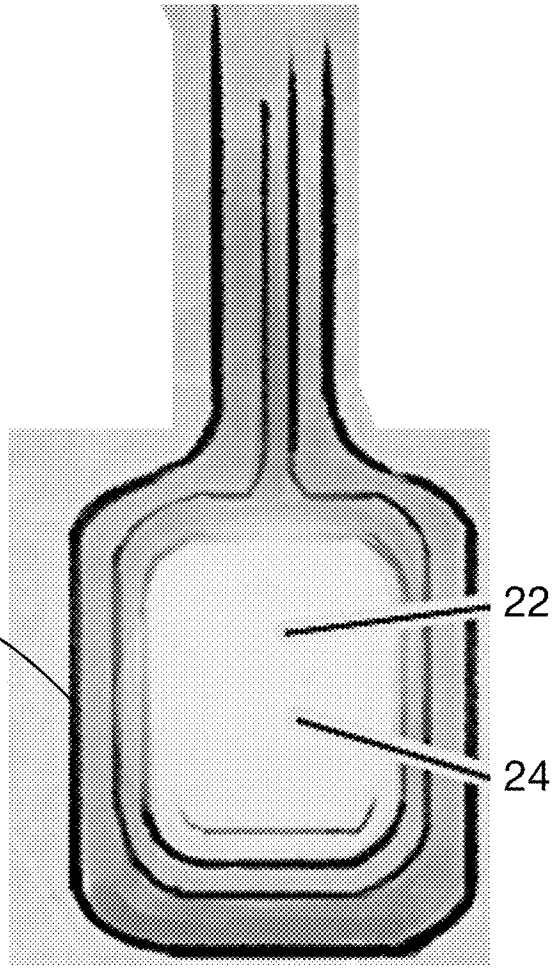
FIGS. 4A and 4B provide side and front views of a status indicator panel for use in connection with a helmet fitted with one or more strips of LED elements, in accordance with embodiments of the present invention.
Figure 4A:
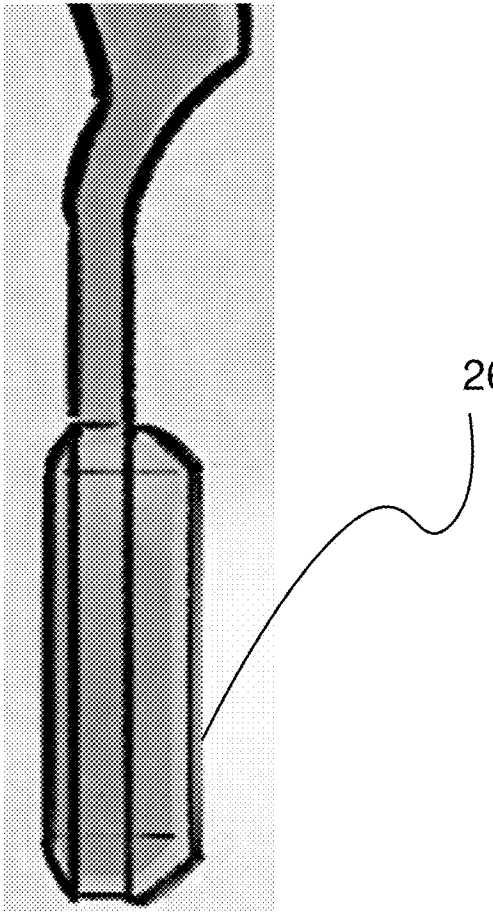

Referring now in addition to FIG. 3, which illustrates in simplified form the electrical connections for the LED strips 12 to a power source 20, it should be recognized that manual control over the on/off state of the LED elements 14 is provided via a switch 22, which may be a clear plastic or glass push-on-push-off switch. When switch 22 is closed, power is supplied to the LED strips 12 from power source 20, and this "on" state is indicated by an illuminated LED 24 mounted on a status indicator panel 26 at the periphery of the front frame of helmet 10. When switch 22 is open, power is not supplied to the LED strips 12 from power source 20, and this "off" state is indicated by LED 24 being off. FIGS. 4A and 4B provide side and front views of the status indicator panel 26 showing the arrangement of the switch 22 and LED 24. In some cases, switch 22 and LED 24 may be included in a single push on/push off unit.

Other electrical arrangements may be used. For example, LED strips 12 may include multiple kinds of LEDs, each individually operable from the status indicator panel 26. For example, strips 12 may be configured with some LEDs that provide light in visible wavelengths, others that provide light in infra-red wavelengths, and still others that provide light in ultra violet wavelengths. Alternatively, or in addition, different ones of strips 12 may be configured with LEDs that provide light in different ones of the visible, infra-red, or ultra violet spectrums. Through selective control of the different types of LEDs, i.e., the different wavelengths of illumination, the wearer may illuminate only some but not all of the LEDs 14 on strips 12. This is especially useful where the wearer wishes to announce his or her presence to searchers equipped with detection devices sensitive in other than visible light wavelengths, while not revealing his/her presence through the illumination of LEDs in the visible light wavelengths to others that may be looking for him/her. In still further embodiments, those LEDs that produce light in the visible spectrum may do so at different colors, allowing the wearer to arrange the LED strips, and hence the individual LEDs, in different colored patterns as a means of communication or warning.

Power source 20 may be a water activated battery, one or more one-time use cells, or one or more rechargeable cells. In some cases, the power source may include a hand crank that can be used to turn a generator to recharge the cell(s) and/or power the LED strips. Although not shown in this view, the power source may be housed off-helmet, e.g., worn on a vest or pack. In some cases, a primary power source may be located off-helmet and a power source 20 may be provided as a secondary power supply in the event the primary power supply is depleted or becomes detached. This would also allow the primary power source to be decoupled from the system, which would then revert to using the secondary power source, at least temporarily. Primary power may later be restored by an attending medic using a transportable power supply. To facilitate this operation, the system may be provided with one or more ports allowing connection of different forms of power supplies.

Figure 5A:
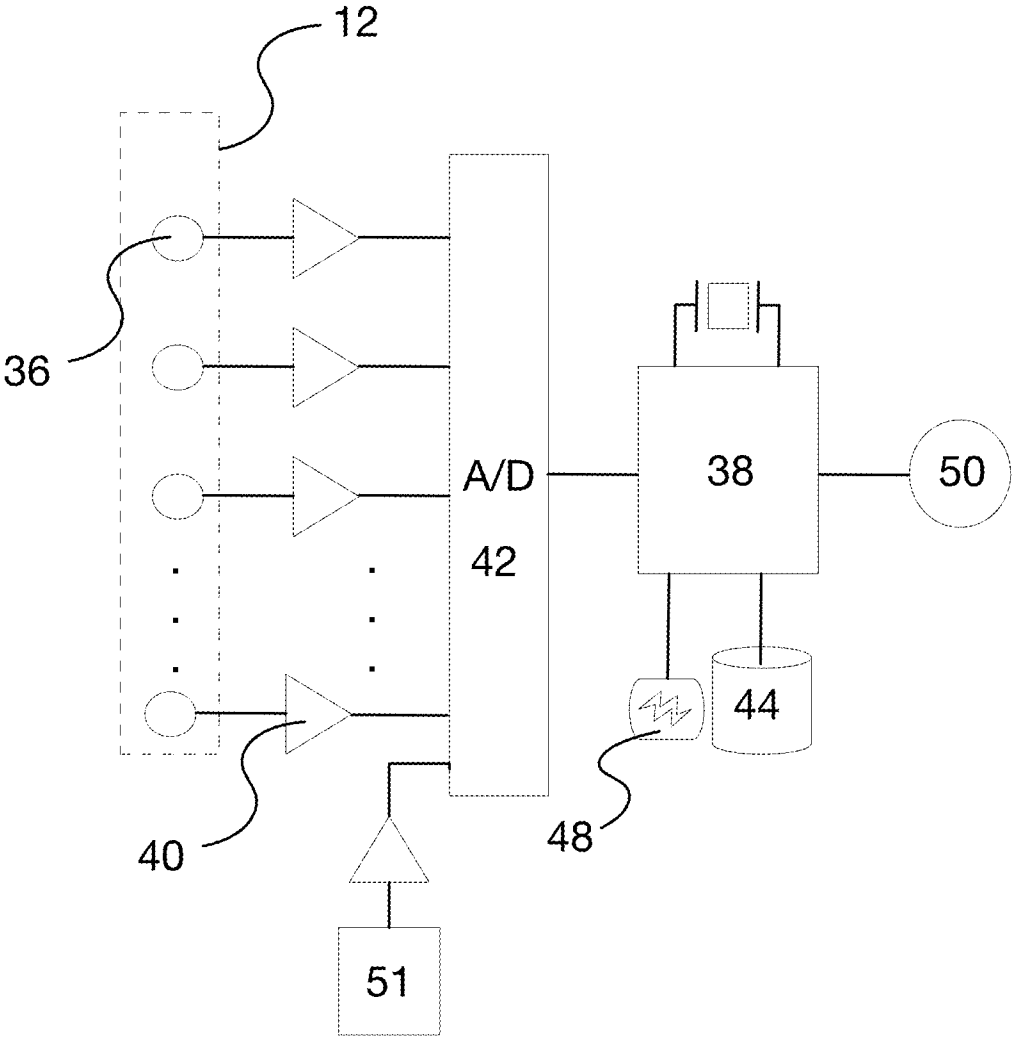
FIG. 5A illustrates an example of an informatics unit for a helmet fitted with one or more strips of LED elements in which one or more strips of LEDs includes one or more sensor pads for monitoring of a wearer's vital statistics, electrophysiological state, or other bioinformation in a non-invasive fashion.

In addition to the LED lights 14, one or more of the strips 12 may extend beneath the helmet 10 and include one or more sensor pads that contact the wearer's skin. Such pads can be used to provide monitoring of a wearer's vital statistics, electrophysiological state, or other bioinformation in a noninvasive fashion, e.g., in connection with prehospital emergency care. As illustrated in FIG. 5A, one or more strips 12 may include one or more sensor pads 36 constructed of conductive fabric that contacts the wearer at the forehead and/or elsewhere (e.g., the nape of the neck, the temples, etc.). One or more of the sensor pads may be integrated in a headband associated with the helmet 10. The sensor pads 36 may be attached by electrical leads to a processor 38, e.g., via associated amplifiers 40, analog-to-digital converters 42, etc., which samples the signals from the sensor pads periodically. A record of the sampled signals may be stored locally at the helmet, e.g., in a suitable writable memory 44 such as a flash memory, and also may be downloaded via an output port 50 by an attending medic. Alternatively, the data may be transmitted off-helmet wirelessly when an associated transmitter is activated, e.g., by an on-scene paramedic or by the wearer him/herself. Upon command, any stored samples may be similarly transmitted so that a history of the wearer's biometric and vital signs can be analyzed by a physician or other person at a remote monitoring station. In some embodiments, additional on-helmet sensors in the form of one or more accelerometers 48 may provide inputs to processor 38 concerning rapid accelerations/decelerations of the wearer's head. Such measurements may be important when assessing possible traumatic brain injuries, cervical spinal injuries, and the like.

Figure 5C:
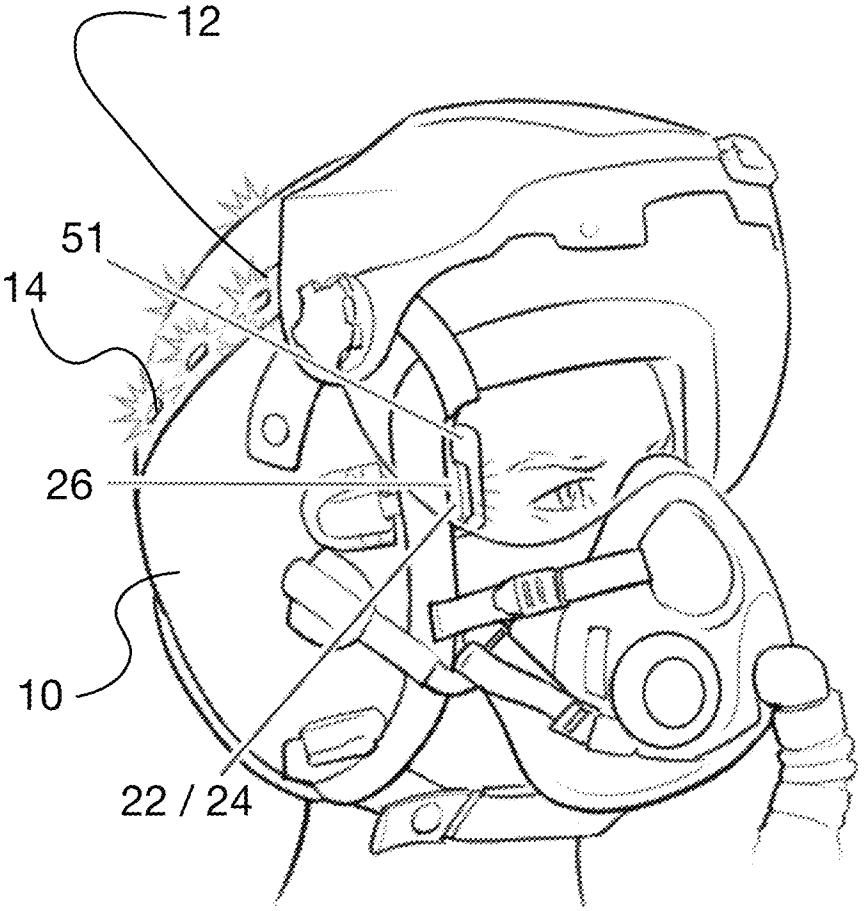
FIGS. 5B and 5C illustrate examples of a status indicator panel for use in connection with a helmet fitted with one or more strips of LED elements and fitted with a vital statistics sensor pad for monitoring of a wearer's vital statistics, electrophysiological state, or other bioinformation in a non-invasive fashion, in accordance with embodiments of the present invention.
Figure 5B:
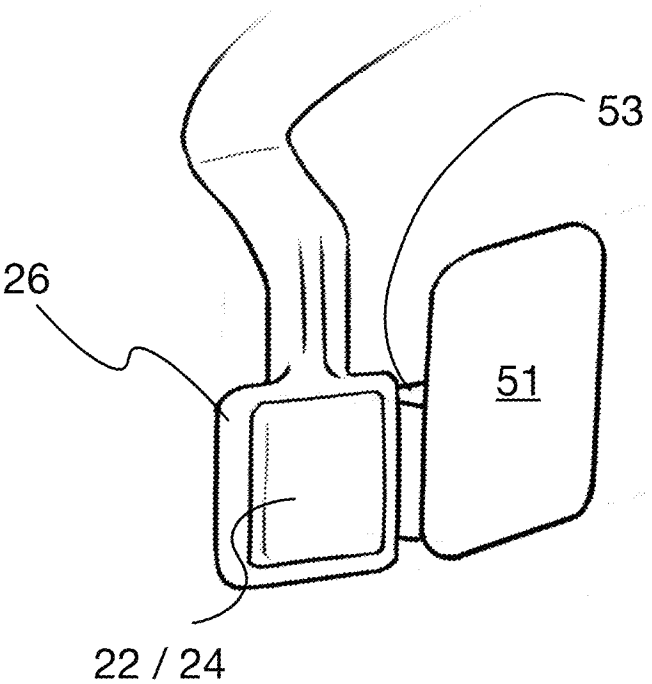

With further reference to FIGS. 5B and 5C, in addition to or in lieu of the sensor pads 36, a vital statistics sensor pad 51 may be mounted to the status indicator panel 26 using a quick release connector 53 so that it contacts the wearer at or near the temple. Vital statistics sensor pad 51 may be attached by electrical leads to processor 38, e.g., via an associated amplifier 40, analog-to-digital converter 42, etc., which samples and stores/transmits the signals from vital statistics sensor pad 51 periodically. By using a quick release connector 53, the vital statistics sensor pad 51 may remain affixed to the wearer when the helmet 10 is removed. Further, an amplifier 40, analog-to-digital converter 42, processor 38, writable memory 44 and output port 50 (along with other necessary electronic component) may be integrated in vital statistics sensor pad 51 so that the unit is a self-contained vital statistic monitoring element that remains with the wearer even after the helmet is removed.

By securing the LED strips 12 using hook and eye fasteners (or an equivalent thereof), the present invention provides a lighting system for a helmet, and in one embodiment an aircrew member's helmet, which lighting system includes reconfigurable strips of LED lights. The LED strips, and hence the individual LEDs, are selectably controllable to be illuminated or not, to be fashioned into illumination arrangements that can communicate information to searchers or others, and to be removed from the helmet entirely and attached to other locations on a wearer's clothes or equipment if needed.

As should be apparent from the foregoing description, the present invention affords many advantages for a wearer. For example, where activated ones of the LEDs emit light outside of the visible spectrum, the wearer can nevertheless confirm the operations status of those LEDs by observing the on/off state of an LED or other indicator on the status indicator panel 26. In some embodiments, therefore, respective indicator LEDs are provided for each different set or type of LEDs on strips 12. For example, there may be separate indicators, and separate on/off switches, on status indicator panel 26 for LEDs or LED strips that emit light in ultra violet wavelengths, for LEDs that emit light in infrared wavelengths, and for LEDS that emit light in visible wavelengths. LEDs (and respective indicators and on/off switches) in this last category may be further subdivided into "white" light LEDs and "color" LEDs, e.g., LEDs that emit light in red, green, blue, yellow, orange, or other colors. Each color group of LEDs or strips of LEDs may have its own indicator and on/off switches. Preferably, the on/off switches are included with the associated indicator as push on/push off indicator switches so as to minimize the amount of space consumed by these devices on the status indicator panel 26. Importantly, the indicator lights on the status indicator panel 26 are kept small, with minimal light output, and are oriented so as to be visible only to the wearer of the helmet so that when an illuminator on the status display panel is illuminated it is not readily visible to others or to unmanned observation equipment.

Figure 6:
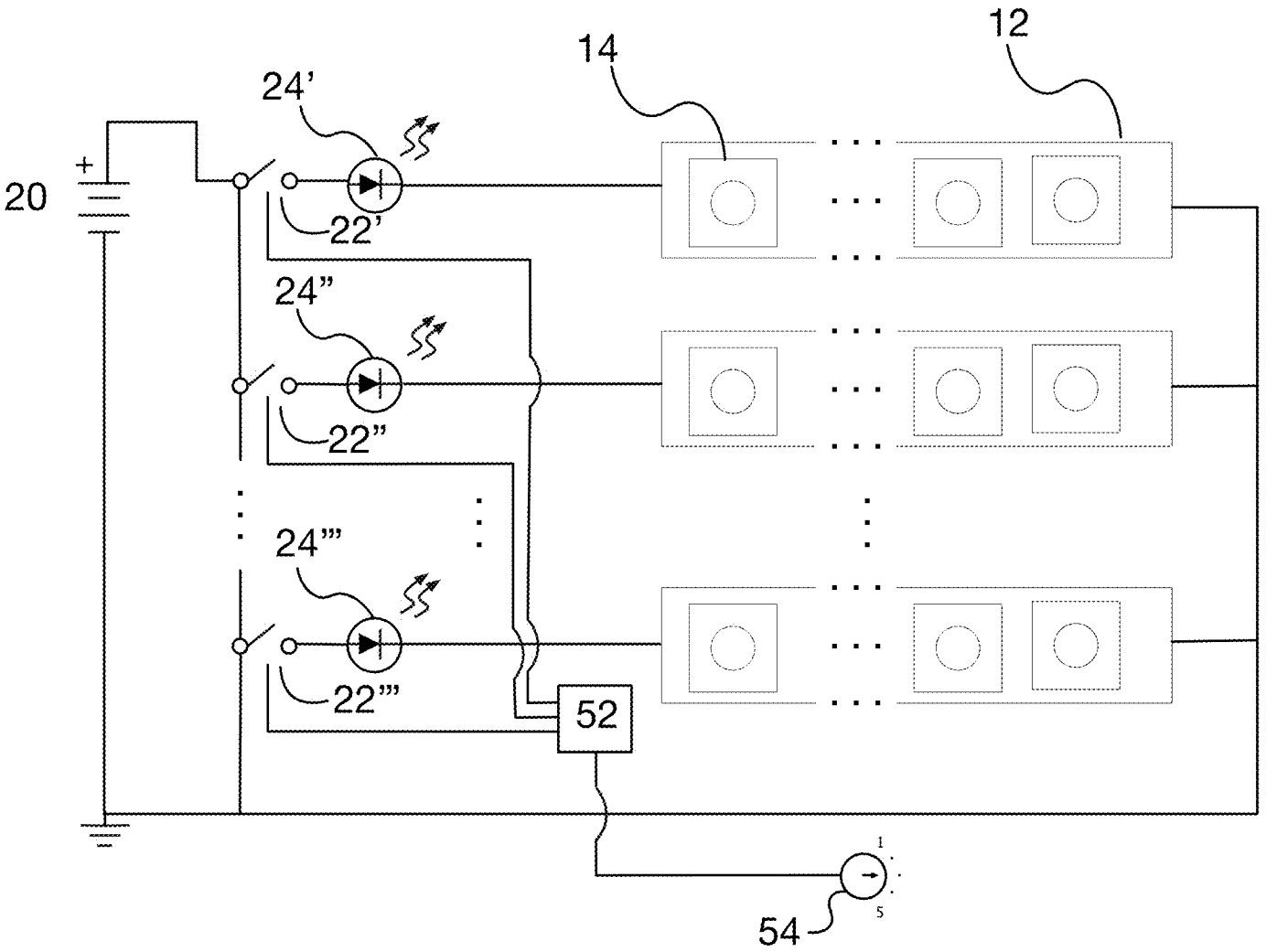
FIG. 6 shows the use of a programmed controller for providing different light patterns for LED elements arranged in strips for use in connection with a helmet, in accordance with embodiments of the present invention.

Because LEDs of various types are provided, different light patterns, including strobe patterns may be effected by alternatingly powering on and off various ones of the LEDs 14 on strips 12. In some cases, this may be accomplished using a programmed controller that operates one or more switches. An example of such an arrangement is illustrated in FIG. 6. Controller 52 (which in one embodiment is a microprocessor with integrated or separate program memory) is programmed with one or more illumination patterns, selectable by the wearer using a selection means such as a rotary dial selector 54, pushbuttons, one or more switches, voice command activation, or other means. In accordance with the selected illumination program, controller 52 operates switches 22', 22", 22", etc., in accordance with a choice made via selector 54, to power on/off LEDs 14 of strips 12 to effect the desired lighting pattern. Optionally, LED indicators 24', 24", 24', etc. indicate to the wearer when the associated LED strips are illuminated. In other embodiments, a single LED indicator may be used (e.g., on rotary dial selector 54 to indicate the selected illumination pattern or on status indicator panel 26 to indicate activation of the LEDs) or none may be used.

A similar arrangement to that shown in FIG. 6 may be used to activate only selected LEDs or LED strips. That is, through selection means such as rotary dial selector 54, controller 52 may be instructed to operate only desired LEDs 14 or LED strips 12. For example, only rear-facing (from the wearer's standpoint), or forward-facing, or left- or right-side facing, or top-facing LEDs may be activated depending on the circumstances in which the wearer finds him/her-self. The direction and number of illuminated LEDs may, for example, have meaning when communicating with others, or be useful when trying to minimize detection by others.

Further, as mentioned above, because the LED strips are secured by removable fasteners such as hook and eye fabric strips, snaps, or other means, they can be reoriented on the helmet, on the wearer's equipment, or on the wearer's body. This allows for illumination of desired areas, illumination for communication, stowage when not in use, or even marking of a trail. For example, the LED strips may include one or more self-contained power sources, such as solar cells with associated batteries, which allow for the LED strips to be removed from the helmet and used to mark a trail indicating the (now former) wearer's direction of movement. Because the LED strips may include individual, rechargeable power sources, the LEDs, and hence the marked path, will be visible even in low light or nighttime conditions.

Further, the benefits provided by including extended strips that are fitted with sensors 36 allows for monitoring of the wearer's vital signs. This monitoring may be associated with selected LED illumination patterns so that emergency or informational illumination patterns are activated (e.g., by a controller such as 52 that receives a signal from a controller such as 38) when the wearer's vital signs indicate an emergency or other abnormal physiological condition. Such illumination may be especially desirable where, for example, the wearer is unconscious and is unable to manually activate the LEDs.

Thus, a reconfigurable lighting system for a helmet, and in particular an aircrew member's helmet, has been described.

What is claimed is:

1. A helmet, comprising one or more strips of light emitting diode (LED) lights, different ones of the LED lights being configured to provide light in different light spectrums and the one or more strips of LED lights being coupled to a programmed controller that is configured to provide an LED light illumination pattern according to a position of a selector, said one or more strips of LED lights being removably secured to said helmet within associated recessed channels in the helmet, the recessed channels being deep enough so that a top portion of the LED lights of the respective one of the one or more strips of LED lights is flush with or slightly protrudes above a top surface of the helmet, an on/off switch to allow a wearer to set an on/off status of the LED lights, an indicator disposed at a periphery of a front frame of the helmet to allow the wearer to observe the on/off status of the LED lights, wherein the on/off switch and the indicator are included in a single push on/push off unit, and a vital statistics sensor pad that is attached to the indicator, wherein the vital statistics sensor pad is attached to the indicator by a quick release connector so as to allow the vital statistics sensor pad to remain affixed to the wearer at or near a temple of the wearer when the helmet is removed from the wearer.

2. The helmet of claim 1, wherein the on/off switch is a manual on/off switch operable by the wearer.

3. The helmet of claim 1, further comprising a power supply for the LED lights.

4. The helmet of claim 3, wherein the power supply includes a water-activated battery.

5. The helmet of claim 4, wherein the water-activated battery is a component of the on/off switch.

6. The helmet of claim 3, wherein the power supply includes a hand-powered generator.

7. The helmet of claim 1, wherein the one or more strips of LED lights are removably secured to said helmet by hook and eye fasteners.

8. The helmet of claim 1, wherein a first strip of male or female hook and eye elements is adhered within the recessed channel in the helmet and a corresponding second strip of female or male hook and eye elements adhered to one of the one or more strips of LED lights engages the first strip within the recessed channel.

9. The helmet of claim 1, wherein the on/off switch is included in a panel with the indicator at the periphery of the front frame of the helmet.

10. The helmet of claim 1, wherein the one or more strips of LED lights include multiple kinds of LEDs, each individually operable from a panel that includes the indicator.

11. The helmet of claim 1, wherein at least some of the LED lights provide light in visible wavelengths.

12. The helmet of claim 1, wherein at least some of the LED lights provide light in infra-red wavelengths.

13. The helmet of claim 1, wherein at least some of the LED lights provide light in ultra violet wavelengths.

14. The helmet of claim 1, wherein different ones of the LED lights are configured to provide light in different ones of visible, infra-red, or ultra violet spectrums.

15. The helmet of claim 1, wherein different ones of the LED lights are selectively controllable to provide different wavelengths of illumination.

16. The helmet of claim 1, wherein different ones of the LED lights are selectively controllable to provide illumination.

17. The helmet of claim 1, wherein different ones of the LED lights are selectively controllable to produce light in a visible light spectrum at different colors.

18. The helmet of claim 1, wherein the one or more strips of LED lights also includes one or more sensor pads configured to provide monitoring of at least one vital statistic, electrophysiological state, or other bioinformation of the wearer.

19. The helmet of claim 1, further comprising one or more sensor pads to provide monitoring of at least one vital statistic, electrophysiological state, or other bioinformation of a wearer, the one or more sensor pads integrated in a headband associated with the helmet.

20. The helmet of claim 1, wherein the vital statistics sensor pad includes a processor.

21. The helmet of claim 1, wherein separate types of the LED lights have separate, respective status indicators and separate, respective on/off switches.

* * * * *